United States Patent [19]

Krouzkevitch et al.

[11] Patent Number: 4,839,966

[45] Date of Patent: Jun. 20, 1989

[54] HAND-CARRIED TOOL FOR CUTTING PLASTER-LIKE MATERIAL

[76] Inventors: Benjamin Krouzkevitch, 70 Shelford Ave., San Carlos, Calif. 94070; Alexander Litvinenko, 1974 Middle Two Rock Rd., Petaluma, Calif. 94952

[21] Appl. No.: 144,603

[22] Filed: Jan. 11, 1988

Related U.S. Application Data

[63] Continuation of Ser. No. 934,006, Nov. 24, 1986, abandoned.

[51] Int. Cl.[4] ..... B27C 1/10

[52] U.S. Cl. ..... 30/475; 144/117 C

[58] Field of Search ..... 30/475, 476, 477; 144/117 R, 117 C, 225

[56] References Cited

U.S. PATENT DOCUMENTS

| | | | |
|---|---|---|---|
| 1,170,454 | 2/1916 | Magerkurth | 30/475 X |
| 1,279,488 | 9/1918 | Broward | 30/475 |
| 2,437,668 | 3/1948 | Adams | 30/475 X |
| 2,894,549 | 7/1959 | Garland | 30/475 |
| 2,969,816 | 1/1961 | Johnsa | 144/117 R |
| 3,506,044 | 4/1970 | Evans | 30/475 X |
| 3,557,658 | 1/1971 | Jamison | 30/475 X |
| 4,360,048 | 11/1982 | Schadlich et al. | 30/475 |

*Primary Examiner*—Frank T. Yost
*Assistant Examiner*—Michael D. Folkerts
*Attorney, Agent, or Firm*—Flehr, Hohbach, Test, Albritton & Herbert

[57] ABSTRACT

A hand-carried tool includes one or more cutting cylinders rotatably supported and power from a compressed air operable motor causes them to rotate around their axes. Each cutting cylinder has cutting sections and grooves formed alternately along its length and each cutting section has two or more edge pieces spirally protruding in radially outward directions. The cutting edges on these edge pieces are parallel to the axis of rotation and separated mutually by more than 7 mm so as to reduce the amount of plaster powder produced.

9 Claims, 1 Drawing Sheet

HAND-CARRIED TOOL FOR CUTTING PLASTER-LIKE MATERIAL

This is a continuation of application Ser. No. 934,006 filed Nov. 24, 1986, now abandoned.

BACKGROUND OF THE INVENTION

This invention relates to a hand-carried tool for cutting plaster-like material and more particularly to such a tool to be used in an automobile body shop for making a smooth surface without producing any powder.

In automobile body repair operations, it is a usual practice to apply a metallic or plaster-like material and then to smooth the material surface. The smoothing operation is typically carried out with coarse sandpaper. Hand-held tools for smoothing and finishing such surfaces have been disclosed, for example, U.S. Pat. Nos. 2,043,509, 2,925,644 and 2,987,970 but the tools disclosed in these patents cannot reduce the amount of powder which is produced and pollutes the workers' environment. Moreover, plaster is more frequently used in automobile body shops and, plaster being sticky, the space between edges of these prior art tools becomes clogged easily.

SUMMARY OF THE INVENTION

It is therefore an object of the present invention to provide an improved tool for cutting plaster-like material.

It is another object of the present invention to provide a hand-carried tool for cutting plaster-like material for smoothing a surface without producing a large amount of powder.

It is still another object of the present invention to provide a tool of the aforementioned type which prevents clogging of cutting edges.

The above and other objects of the present invention are achieved by providing a tool with one of or more rotatable cutting cylinders on which cutting sections and grooves are alternately formed therealong. These grooves must be sufficiently wide with respect to the cutting sections so as to prevent clogging with cuttings. Each cutting section has cutting edges along its periphery and the edges are separated from one another such that plastic is cut, not ground, and less powder will be produced as a plaster surface is smoothed.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
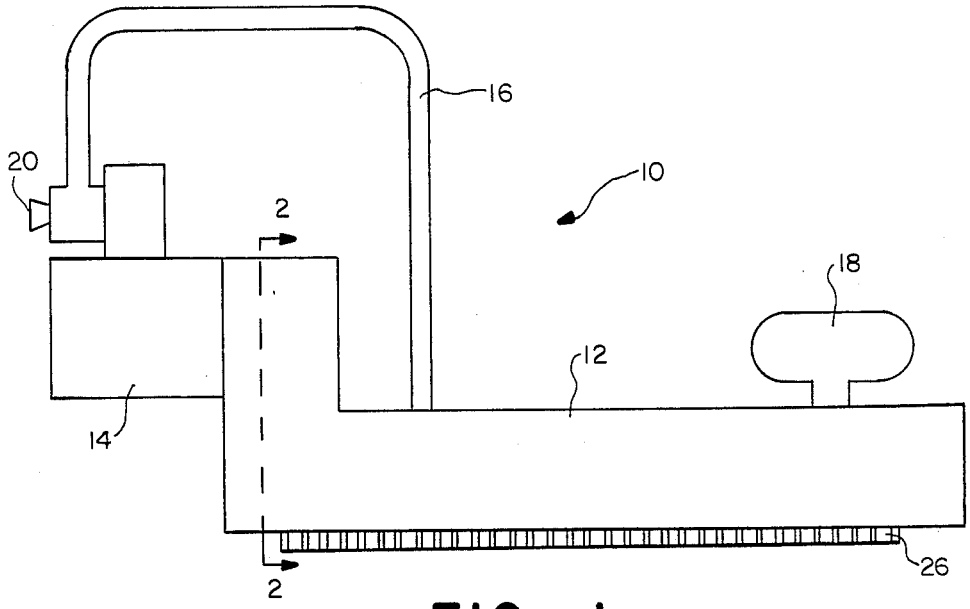
FIG. 1 is a schematic side view of a tool embodying the present invention.

FIG. 1 is a schematic side view of a cutting tool 10 embodying the present invention. For the convenience of operation, It is generally constructed like a carpenter's plane, having a casing 12 with a flat bottom for containing cutting edges while exposing a small portion thereof, a housing 14 for a compressed air operable motor (not shown), a handle 16 and a guide knob 18. Numeral 20 indicates an air inlet through which the motor inside the housing 14 is connected to an external air compressor through a flexible intake hose (not shown) in a well known manner.

Figure 2:
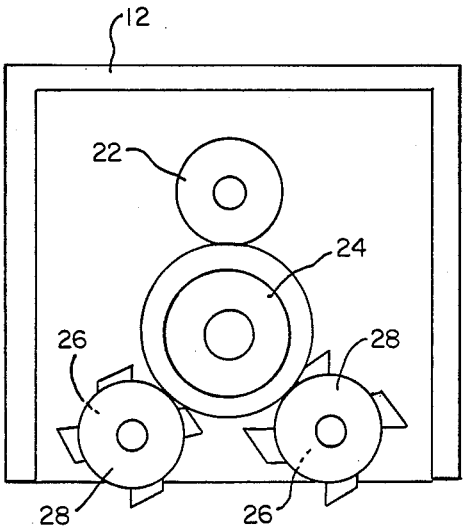
FIG. 2 is a sectional view taken along the line 2—2 of FIG. 1.

As shown in FIG. 2 which is a sectional view taken along the line 2—2 of FIG. 1, the shaft of the aforementioned motor in the housing 14 has gear 22 securely attached thereto. This gear 22 meshes with a larger gear 24 which is mounted rotatably to the casing 12. Two cutting cylinders 26 to be described more in detail below are supported in mutually parallel relationship by the casing 12 such that they are rotatable individually around their central axes. Each of the cutting cylinders 26 has gear 28 rigidly mounted on its axis and engaged with the larger gear 24 such that the rotary motion of the motor is communicated through gears 22, 24 and 28 to cause the cutting cylinders 26 to rotate around their axes.

Figure 3:
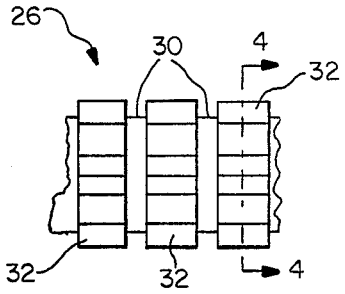
FIG. 3 is a side view of a portion of a cutting cylinder according to the present invention.

As shown in FIG. 3 which is a side view of a small segment of the cutting cylinder 26, each cutting cylinder 26 has grooves 30 of width about 2mm and cutting sections 32 of width about 5mm formed alternately along its length. The total length of each cutting cylinder 26 according to one embodiment is about 25 cm within which 32 cutting sections and 31 grooves are formed.

Figure 4:
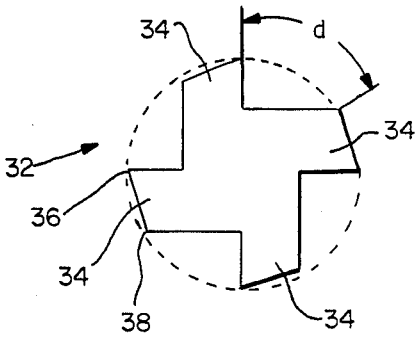
FIG. 4 is a sectional view taken along the line 4—4 of FIG. 3.

As shown in FIG. 4 which is a sectional view of a cutting section 32 taken along the line 4—4 of FIG. 3, each cutting section 32 is formed with four edge pieces 34 spirally protruding in radially outward direction. Each edge piece 34 has a flat cutting face which extends substantially radially with a cutting edge 36 at the end, that is, along the outer periphery which is parallel to the axis of the cutting cylinder as better seen in FIG. 3. The external periphery of each edge piece 34, or the overhang, is so shaped that no part of the edge piece 34 is at a greater distance from the axis of rotation of the cutting cylinder 26 than the cutting edge 36. This must be so because, when the tool 10 is about to be used with the cutting cylinders rotating to smooth a surface, the cutting edges 36 should be the parts that first contact the target surface. According to the embodiment shown in FIG. 4, the back edge of each edge piece 24 (indicated by numeral 38) is approximately at the same distance from the center of rotation as the cutting edge 26. The present invention has been described above by way of only one embodiment illustrated in FIGS. 1 through 4, but the particular details desctribed above are not intended to limit the scope of the invention. For example, the dimensions and general shapes of various components as well as the number of cutting cylinders inside the casing and the number of cutting sections on each cylinder may be varied. In order to prevent clogging of the surface of the cutting cylinders with the cuttings or scrapings from the work surface, the grooves 30 must be sufficiently wide. If the grooves 30 are too wide, on the other hand, the work surface does not become satisfactorily smooth. For these reasons, the width of each groove 30 should preferably be between 1/1 and $\frac{1}{4}$ of that of the cutting section 32.

In order to prevent a large amount of powder from becoming produced, furthermore, the edges around each edge piece must be separated sufficiently far apart. According to a successful embodiment of the present invention illustrated in FIG. 4, the distance (indicated by "d" therein) between each cutting edge and the opposite back edge on the adjacent edge piece is about 1 cm. This distance must be greater than about 0.7 cm according to the present invention to keep the amount of plaster powder produced to a satisfactorily low level.

With a tool of the present invention formed according to the description given above, automobile body work can be carried out not only efficiently but without producing a large amount of plaster powder. Currently, automobile body shops consume a great quantity of coarse sandpaper and the workers labor in an environment which is dense with plaster powder. A tool of the present invention is easy to handle, and adapts to any contour. High rotational speeds of the cutting cylinders are obtainable by use of a compressed air operable motor rather than an electric motor, and this further makes the control of rotational speeds easier. Any modifications or variations which may be apparent to a person skilled in the art are intended to be included within the scope of the invention.

What is claimed is:

1. A hand-carried tool for cutting plasterlike material to produce a smoothed surface, comprising a casing, one or more elongated cutting cylinders each attached to said casing rotatably around an axis, a compressed air operable motor, and power communicating means serving to communicate motion of said motor to said elongated cutting cylinders, each of said cutting cylinders having cutting sections and grooves alternately formed sequentially and longitudinally therealong, mutually adjacent ones of said cutting sections being separated by one of said grooves, said grooves being formed completely around said cylinders circumferentially, each cutting section having two or more edge pieces protruding radially and spaced evenly around said axis, each edge piece having a cutting edge parallel to said axis, the distance between one of said cutting edges and the opposite one of said edge pieces to said one of said cutting edges being at least 0.7 cm.

2. The tool of claim 1 wherein each of said cutting sections includes four edge pieces.

3. The tool of claim 1 wherein each edge piece is so shaped that no part thereof is farther from the axis of rotation of said cutting cylinder than said cutting edge.

4. The tool of claim 1 wherein the width of each of said cutting section is 1–4 times that of said groove.

5. The tool of claim 1 which includes two cutting cylinders.

6. The tool of claim 1 wherein said power communicating means include gears engaging one another.

7. The tool of claim 1 wherein said casing is elongated in one direction, said direction being parallel to said axis.

8. The tool of claim 1 wherein said grooves are about 2mm in width.

9. The tool of claim 1 wherein each of said cutting cylinders has about 32 cutting sections.

* * * * *

UNITED STATES PATENT AND TRADEMARK OFFICE

CERTIFICATE OF CORRECTION

PATENT NO. : 4,839,966

DATED : June 20, 1989

INVENTOR(S) : Krouzkevitch et al.

It is certified that error appears in the above—identified patent and that said Letters Patent is hereby corrected as shown below:

col. 1, ln. 46, "plastic" should read --plaster--.

col. 2, ln. 52, "desctribed" should read --described--.

Signed and Sealed this

Tenth Day of July, 1990

*Attest:*

HARRY F. MANBECK, JR.

*Attesting Officer*

*Commissioner of Patents and Trademarks*